US008409416B2

(12) United States Patent
Takahashi et al.

(10) Patent No.: US 8,409,416 B2
(45) Date of Patent: Apr. 2, 2013

(54) DEVICE FOR REMOVING FOREIGN MATERIAL FROM PROCESSING TANK

(75) Inventors: Kazuaki Takahashi, Iruma (JP); Shunsuke Watanabe, Tokyo (JP)

(73) Assignees: Honda Motor Co., Ltd., Tokyo (JP); Industria Co., Ltd., Iruma-Shi (JP)

( * ) Notice: Subject to any disclaimer, the term of this patent is extended or adjusted under 35 U.S.C. 154(b) by 248 days.

(21) Appl. No.: 12/864,157

(22) PCT Filed: Jan. 21, 2009

(86) PCT No.: PCT/JP2009/000211

§ 371 (c)(1),
(2), (4) Date: Oct. 20, 2010

(87) PCT Pub. No.: WO2009/093449

PCT Pub. Date: Jul. 30, 2009

(65) Prior Publication Data

US 2011/0042207 A1 Feb. 24, 2011

(30) Foreign Application Priority Data

Jan. 22, 2008 (JP) ..... 2008-011746

(51) Int. Cl.
*C25D 1/12* (2006.01)

(52) U.S. Cl. ..... 204/623

(58) Field of Classification Search ..... 204/623
See application file for complete search history.

(56) References Cited

U.S. PATENT DOCUMENTS 6,139,708 A 10/2000 Nonomura

FOREIGN PATENT DOCUMENTS

| | | | |
|---|---|---|---|
| DE | 69813983 | | 3/2004 |
| EP | 0905286 | | 3/1999 |
| JP | 1-106573 | | 7/1989 |
| JP | 11-106996 | | 4/1999 |
| JP | 11-123341 | * | 5/1999 |
| JP | 2001-129313 | * | 5/2001 |

* cited by examiner

*Primary Examiner* — Kishor Mayekar
(74) *Attorney, Agent, or Firm* — Rankin, Hill & Clark LLP

(57) ABSTRACT

An electrodeposition tank that pools and enables fluidization and agitation of an electrodeposition paint into which a work is to be immersed, the electrodeposition tank including: a grooved part having a plurality of concave and convex shapes formed along a work-conveying direction on a bottom surface of the electrodeposition tank; an electrodeposition paint supply pipe that circulates and supplies the electrodeposition paint to the electrodeposition tank; a plurality of branch pipes that are arranged on ridges of the grooved part and that branch off the electrodeposition paint supply pipe; and electrodeposition paint discharge nozzles provided oriented upstream in the work-conveying direction at a section of the branch pipes that opposes bottom parts of the grooved part.

5 Claims, 10 Drawing Sheets

DEVICE FOR REMOVING FOREIGN MATERIAL FROM PROCESSING TANK

TECHNICAL FIELD

The present invention relates to a processing tank for fluidizing and agitating a processing liquid into which a work is to be immersed.

BACKGROUND ART

With a processing tank that pools a processing liquid containing a sedimentable component such as an electrodeposition paint, a known method for preventing settling of the sedimentable component involves arranging ejector nozzles side by side at a predetermined pitch on the bottom part of the processing tank in a width direction of the tank, arranging groups of such ejector nozzles side by side in a longitudinal direction of the tank, and having each ejector nozzle eject the processing liquid to fluidize and agitate the processing liquid pooled in the processing tank (for example, refer to Patent Document 1).

Patent Document 1: Japanese Utility Model Laid-Open No. 01-106573

DISCLOSURE OF THE INVENTION

Problems to be Solved by the Invention

However, with a technique such as that described in Patent Document 1, in order to reliably prevent settling of the processing liquid by fluidizing and agitating the same, an installation pitch of the respective ejector nozzles must be reduced and a larger circulation pump for supplying the processing liquid to each ejector nozzle so that the processing liquid is ejected with a predetermined pressure must be prepared. Consequently, the problem of increased cost arises.

The present invention has been made in consideration of such a problem existing in the conventional art, and an object of the present invention is to provide a processing tank with a simple construction which enables fluidization and agitation of a processing liquid in order to reliably prevent settling of the processing liquid.

Means for Solving the Problems

In order to solve the problems described above, a first aspect of the present invention is a processing tank that pools and enables fluidization and agitation of a processing liquid into which a work is to be immersed, the processing tank including: a grooved part having a plurality of concave and convex shapes formed along a work-conveying direction on the bottom surface of the processing tank; a processing liquid supply pipe that circulates and supplies the processing liquid to the processing tank; a plurality of branch pipes which are arranged on convexities of the grooved part and which branch off the processing liquid supply pipe; and processing liquid discharge nozzles provided oriented upstream in the work-conveying direction at a section of the branch pipes which opposes the center of the concavities of the grooved part.

A second aspect of the present invention is the processing tank according to the first aspect of the present invention, wherein the grooved part is formed by arranging, side by side, steel plate members having gutter shapes, the concavities are bottom parts of the steel plate members, and the convexities are ridges of the steel plate members.

A third aspect of the present invention is the processing tank according to the first aspect of the present invention, wherein the grooved part is formed by arranging, side by side, steel plate members having serrated shapes, the concavities are valleys of the steel plate members, and the convexities are ridges of the steel plate members.

Advantages of the Invention

According to the first aspect of the present invention, the processing liquid which naturally tends to settle in the processing tank is carried by a flow of processing liquid ejected from the processing liquid discharge nozzle and converges in a vicinity of convexities of the grooved part, and the processing liquid is consecutively fluidized and agitated and does not settle.

According to the second aspect of the present invention, the concavities and convexities of the grooved part can be readily formed using steel plate members having gutter shapes, and a flow of the processing liquid can be created which enables the processing liquid to be fluidized and agitated while preventing settling thereof.

According to the third aspect of the present invention, the concavities and convexities of the grooved part can be readily formed using steel plate members having serrated shapes, and a flow of the processing liquid can be created which enables the processing liquid to be fluidized and agitated while preventing settling thereof.

DESCRIPTION OF SYMBOLS

Figure 1:
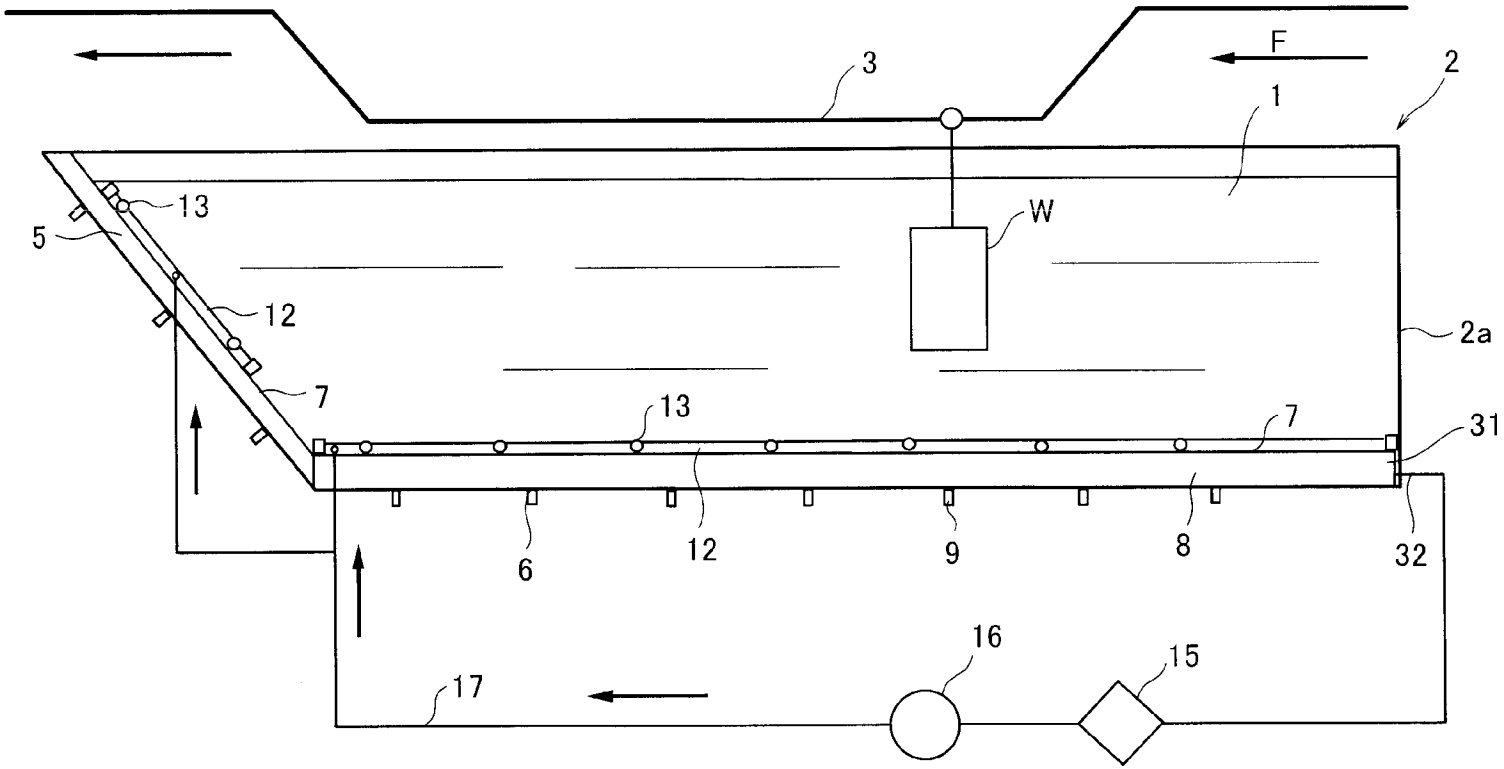
FIG. 1 is an explanatory diagram of a schematic configuration of a first embodiment of a processing tank according to the present invention.

1 electrodeposition paint
2 electrodeposition tank
3 conveyor
5 inclined part
6 bottom surface
7, 27 grooved part
7*a*, 27*a* end part

8, 28 steel plate member
9, 29 reinforcing member
10*a* concavity (bottom part)
10*b*, 30*b* convexity (ridge)
12 electrodeposition paint supply pipe
13 branch pipe
14 electrodeposition paint discharge nozzle
15 filter
16 circulation pump
17 electrodeposition paint circulation pipe
30*a* concavity (valley)
31, 41 collecting part
32, 42 discharge pipe
W work

BEST MODE FOR CARRYING OUT THE INVENTION

Figure 2:
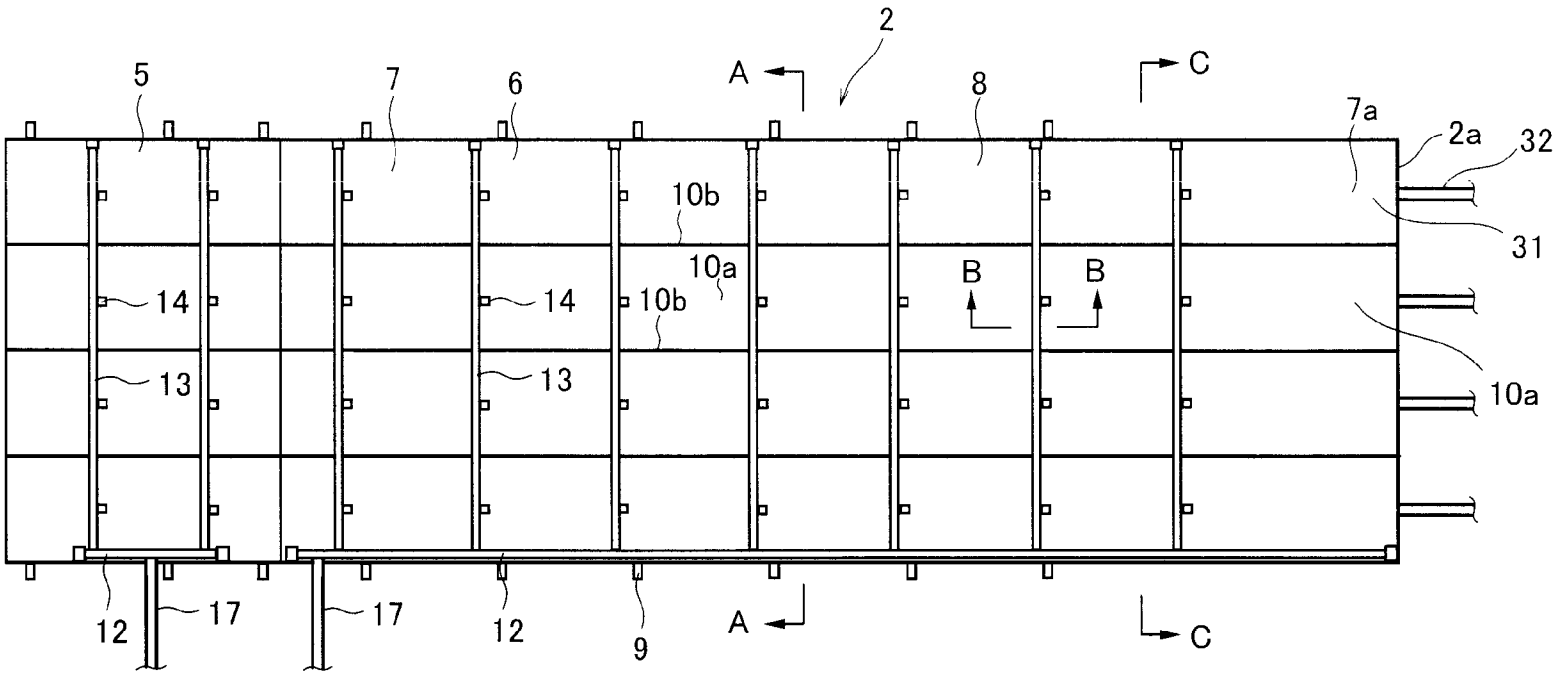
FIG. 2 is a plan view of the first embodiment of a processing tank according to the present invention.
Figure 3:
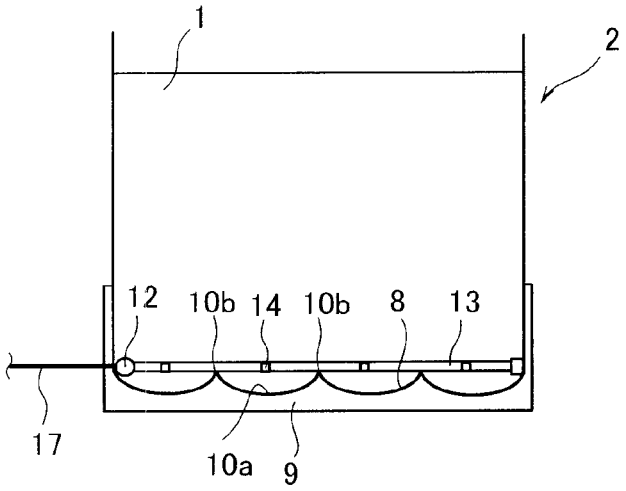
FIG. 3 is a cross-sectional fragmentary view taken along A-A in FIG. 2.
Figure 4:
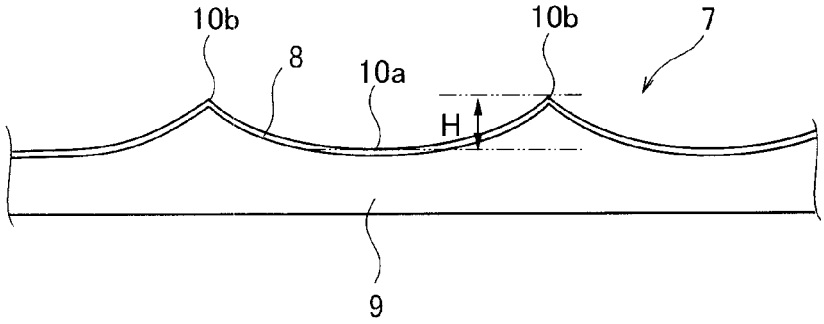
FIG. 4 is an enlarged view of a substantial part of FIG. 3.
Figure 5:
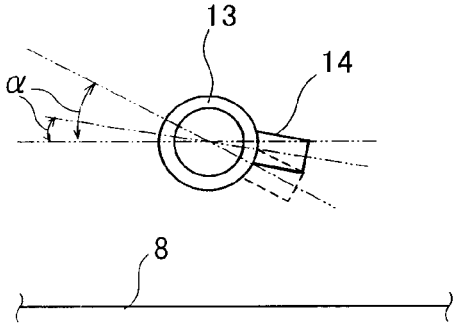
FIG. 5 is an enlarged cross-sectional fragmentary view taken along B-B in FIG. 2.
Figure 6:
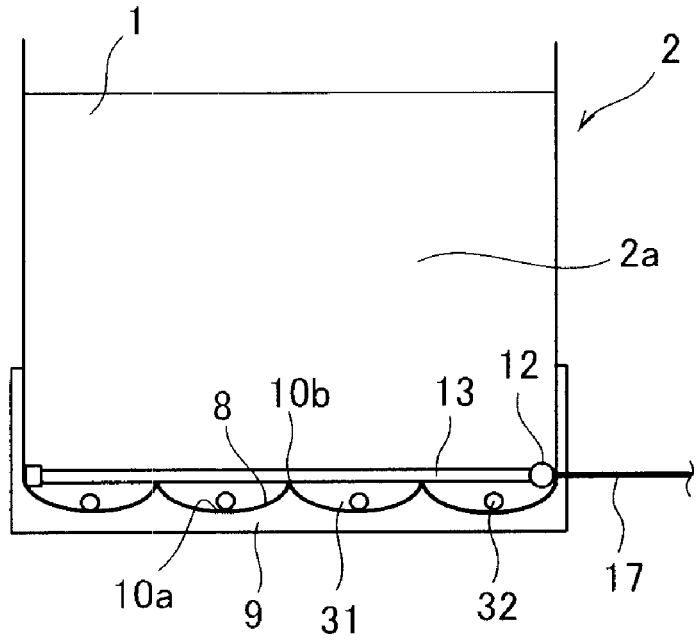
FIG. 6 is a cross-sectional fragmentary view taken along C-C in FIG. 2.
Figure 7:
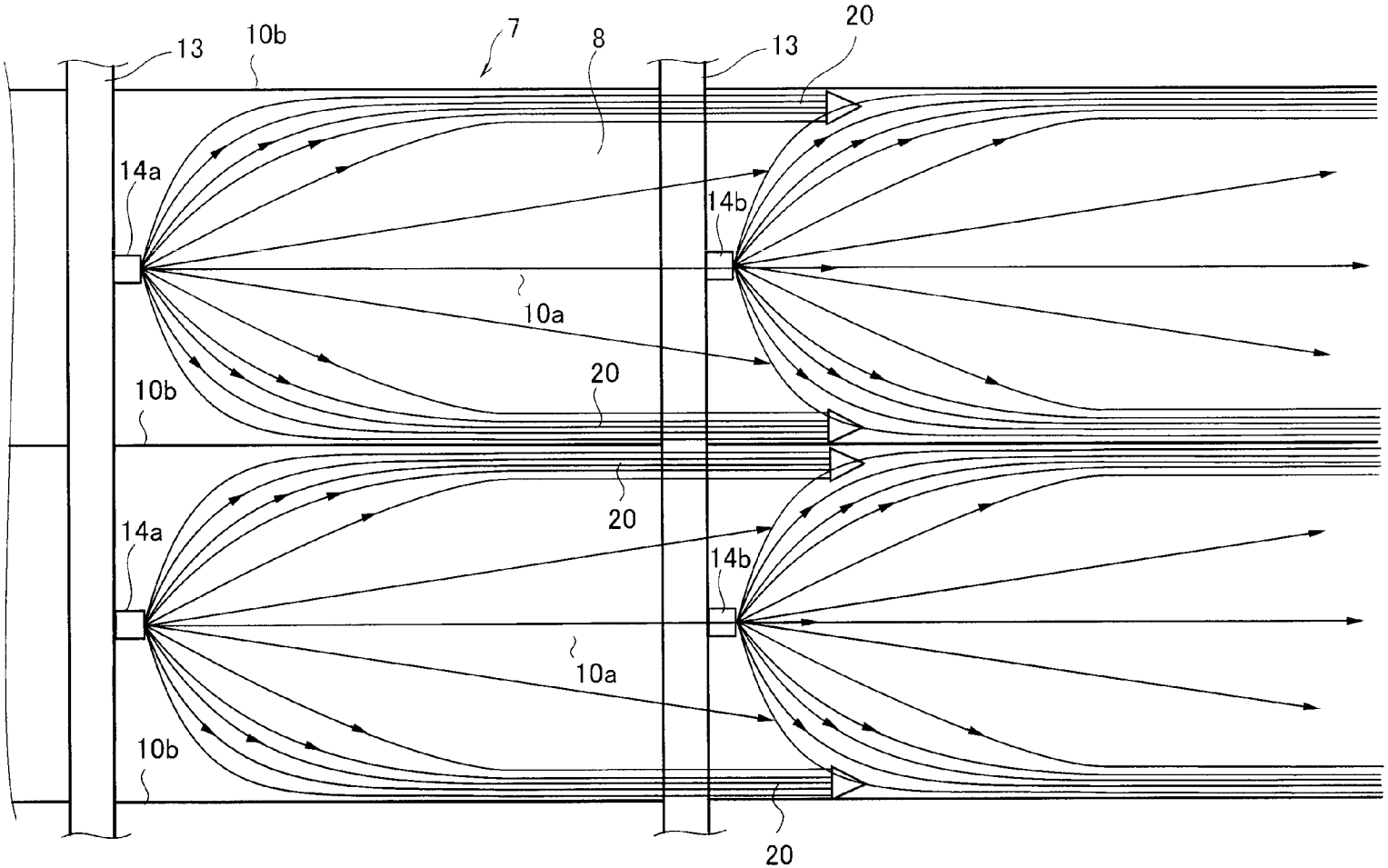
FIG. 7 is an explanatory diagram of operations of the first embodiment.

Hereinafter, embodiments of the present invention will be described with reference to the accompanying drawings. In the drawings: FIG. 1 is an explanatory diagram of a schematic configuration of a first embodiment of a processing tank according to the present invention; FIG. 2 is a plan view of the same; FIG. 3 is a cross-sectional fragmentary view taken along A-A in FIG. 2; FIG. 4 is an enlarged view of a substantial part of FIG. 3; FIG. 5 is an enlarged cross-sectional fragmentary view taken along B-B in FIG. 2; FIG. 6 is a cross-sectional fragmentary view taken along C-C in FIG. 2; and FIG. 7 is an explanatory diagram of operations of the first embodiment.

As illustrated in FIGS. 1 and 2, a first embodiment of a processing tank according to the present invention is an electrodeposition tank 2 which holds an electrodeposition paint 1 in which a work W is immersed to be subjected to electrodeposition painting. A conveyor 3 for suspending and immersing the work W in the electrodeposition paint 1 while conveying the work W in the direction indicated by an arrow F (work-conveying direction) is installed above the electrodeposition tank 2. A collecting part 31 as a suction inlet for circulating the electrodeposition paint 1 in the electrodeposition tank 2 is arranged on a work-receiving side of the electrodeposition tank 2. In addition, an inclined part 5 is formed on the work-discharging side of the electrodeposition tank 2. A grooved part 7 having a plurality of concave and convex shapes is formed along the work-conveying direction from the inclined part 5 to a bottom surface 6 of the electrodeposition tank 2.

As illustrated in FIG. 3, the grooved part 7 is formed by welding and bonding together a plurality of steel plate members 8 having a plurality of concave and convex shapes (a shape in which gutter shapes are arranged side by side) manufactured by press-molding, and reinforcing an outer frame of the welded and bonded steel plate members 8 with a reinforcing member 9. Concavities 10*a* of the grooved part 7 are bottom parts of the steel plate members 8, and convexities 10*b* of the grooved part 7 are ridges of the steel plate members 8. The grooved part 7 is extended to an end surface 2*a* of the electrodeposition tank 2. The bottom part 10*a* of an end part 7*a* of the grooved part 7 is to be used as the collecting part 31. Moreover, surfaces of the electrodeposition tank 2 including the steel plate members 8 are coated with an insulating member. In addition, as illustrated in FIG. 4, a cross section of the steel plate member 8 is formed by a portion of an elliptical shape whose major axis is positioned in a width direction of the electrodeposition tank 2 and whose minor axis is positioned in the height direction of the electrodeposition tank 2. The elliptical shape of the steel plate member 8 applied in the present invention preferably has a major axis-to-minor axis ratio ranging from 1:1 to 8:1. Furthermore, the height H of the steel plate member 8 is equal to or shorter than one half of the minor axis.

An electrodeposition paint supply pipe 12 is respectively arranged on work-conveying direction sides of the inclined part 5 and the bottom surface 6 of the electrodeposition tank 2. A plurality of branch pipes 13 branched from the electrodeposition paint supply pipe 12 extends above the grooved part 7 at regular intervals in a direction perpendicular to the work-conveying direction so as to abut the ridges 10*b* of the grooved part 7. In addition, electrodeposition paint discharge nozzles 14 facing the collecting part 31 are mounted at a section of the branch pipes 13 opposing the center of the bottom parts 10*a* of the grooved part 7.

As illustrated in FIG. 5, the electrodeposition paint discharge nozzle 14 is installed in a direction opposite to the work-conveying direction and with an elevation angle $\alpha$ ranging from 10° to 60° ($10° \leqq \alpha \leqq 60°$) with respect to the bottom parts 10*a* of the grooved part 7. In addition, as illustrated in FIG. 6, a discharge pipe 32 to which an end of the electrodeposition paint circulation pipe 17 is to be connected via a filter 15 and a circulation pump 16 is mounted on the end surface 2*a* of the electrodeposition tank 2 opposing each bottom part 10*a* constituting the collecting part 31 so as to communicate with each bottom part 10*a*. Furthermore, the other end of the electrodeposition paint circulation pipe 17 is connected to the electrodeposition paint supply pipe 12.

A description of operations of the first embodiment of a processing tank according to the present invention configured as described above will now be given. As illustrated in FIG. 7, the electrodeposition paint 1 ejected from an electrodeposition paint discharge nozzle 14*a* of a branch pipe 13 positioned on the downstream-side in the work-conveying direction initially flows from the center of a bottom part 10*a* of the grooved part 7 toward ridges 10*b* on both sides of the center of the bottom part 10*a* and toward the collecting part 31, carries away and agitates pigment components and the like which naturally tend to settle and solidify on the inclined part 5 and the bottom surface 6, and disperses the pigment components and the like, which naturally tend to settle and solidify, into the electrodeposition paint 1. Subsequently, the pigment components and the like, which naturally tend to settle and solidify, converge in a vicinity of the ridges 10*b* on both sides, become a strong flow 20 along the ridges 10*b*, and further flows toward the collecting part 31.

The pigment components and the like, which naturally tend to settle and solidify, flowing toward the hopper 4 join a flow of the electrodeposition paint 1 ejected from an electrodeposition paint discharge nozzle 14*b* of a branch pipe 13 positioned on the upstream-side of the aforementioned electrodeposition paint discharge nozzle 14 in the work-conveying direction and are further carried and agitated toward the collecting part 31. As a result, the pigment components and the like, which naturally tend to settle and solidify, are dispersed into the electrodeposition paint 1. In this manner, the pigment components and the like, which naturally tend to settle and solidify on the inclined part 5 and the bottom surface 6 of the electrodeposition tank 2, are carried by the flow of the electrodeposition paint 1 ejected from the electrodeposition paint discharge nozzle 14 as described above and converge in the vicinity of the ridges 10*b* to be agitated, and are consecutively carried away toward the collecting part 31. Finally, as the flow of the electrodeposition paint 1 comes into contact with the end surface 2*a* of the electrodeposition tank 2, the pigment components and the like, which naturally tend to settle and solidify, are agitated and dispersed. At this point, electrodeposition paint 1 with a high concentration of the pigment components and the like exists at each bottom part 10*a* constituting the collecting part 31.

Subsequently, the electrodeposition paint 1 with a high concentration of the pigment components and the like which exists at the collecting part 31 is suctioned by the circulation pump 16 through the discharge pipe 32 and is once again ejected from the electrodeposition paint discharge nozzle 14 mounted on the branch pipe 13 via the filter 15 arranged on the electrodeposition paint circulation pipe 17 and further via the electrodeposition paint supply pipe 12. In this manner, all pigment components and the like, which naturally tend to settle and solidify, are reliably agitated and ejected from the electrodeposition paint discharge nozzle 14 as the electrodeposition paint 1.

At this point, if the major axis-to-minor axis ratio of the elliptical shape of the steel plate member 8 is less than 1:1, a curvature in the vicinity of the ridge 10*b* increases, making it difficult for a flow of the electrodeposition paint discharge nozzle 14 ejected from the electrodeposition paint 1 to carry pigment components and the like, which naturally tend to settle and solidify, so as to collect the same in the vicinity of the ridge 10*b* on both sides. Consequently, a problem arises in that the pigment components and the like settle and solidify in the vicinity of the ridge 10*b* on both sides. When a discharge pressure and a discharge rate of the electrodeposition paint discharge nozzle 14 are increased in order to prevent such a problem, the size of the circulation pump 16 must be increased, thereby resulting in greater cost.

In addition, if the major axis-to-minor axis ratio of the elliptical shape of the steel plate member 8 exceeds 8:1, an ejection flow of the electrodeposition paint 1 ejected from the electrodeposition paint discharge nozzle 14 diffuses, making it difficult for the pigment components and the like, which naturally tend to settle and solidify, to be carried to a position of an ejection flow of the electrodeposition paint 1 ejected from the electrodeposition paint discharge nozzle 14 of a branch pipe 13 adjacent on the upstream-side in the work-conveying direction. Consequently, a problem arises in that the pigment components and the like settles and solidifies midway. While an installation interval of the branch pipes 13 must be shortened in order to prevent such a problem, shortening the installation interval increases the numbers of the branch pipes 13 and the electrodeposition paint discharge nozzles 14, resulting in greater cost.

Furthermore, the height H of the steel plate member 8 is desirably equal to or shorter than one half of the minor axis for similar reasons as the major axis-to-minor axis ratio of the elliptical shape of the steel plate member 8. As for the elevation angle $\alpha$ of the electrodeposition paint discharge nozzle 14, an elevation angle $\alpha$ that is less than 10° makes it difficult for the pigment components and the like, which naturally tend to settle and solidify, to be carried and agitated towards the collecting part 31. Consequently, a problem arises in that the pigment components and the like settle and solidify. On the other hand, if the elevation angle $\alpha$ of the electrodeposition paint discharge nozzle 14 exceeds 60°, sedimentable components of the electrodeposition paint 1 can no longer be sufficiently carried away and an installation interval of the branch pipes 13 must be reduced. However, reducing the installation interval increases the numbers of the branch pipes 13 and the electrodeposition paint discharge nozzles 14, resulting in greater cost.

Moreover, a discharge pressure and a discharge rate of the circulation pump 16 are to be appropriately set in consideration of the area sizes of the inclined part 5 and the bottom surface 6 of the electrodeposition tank 2, the shape of the steel plate member 8, the elevation angle $\alpha$ of the electrodeposition paint discharge nozzle 14, the specific gravity of the pigment components and the like with a natural tendency to settle and solidify, and the like. The installation interval of the branch pipes 13 is to be appropriately set in consideration of the area sizes of the inclined part 5 and the bottom surface 6 of the electrodeposition tank 2, the shape of the steel plate member 8, the elevation angle $\alpha$ of the electrodeposition paint discharge nozzle 14, the specific gravity of the pigment components and the like with a natural tendency to settle and solidify, and the like, as well as the discharge pressure and the discharge rate of the circulation pump 16 set according thereto.

Moreover, the provision of the collecting part 31 is not limited to the end part 7*a* of the grooved part 7. For example, the collecting part 31 may be provided at the center in a work-conveying direction or at an appropriate position in the electrodeposition tank 2, and the discharge pipe 32 to be connected to the electrodeposition paint circulation pipe 17 may be mounted on the collecting part 31 so as to communicate with each bottom part 10*a* of the grooved part 7. In addition, a configuration may be adopted in which the collecting part 31 is formed as a hopper whose upper opening is positioned on the end surface 2*a* of the electrodeposition tank 2 near the bottom surface 6 and the electrodeposition paint circulation pipe 17 is connected to a rear end of the hopper.

Figure 8:
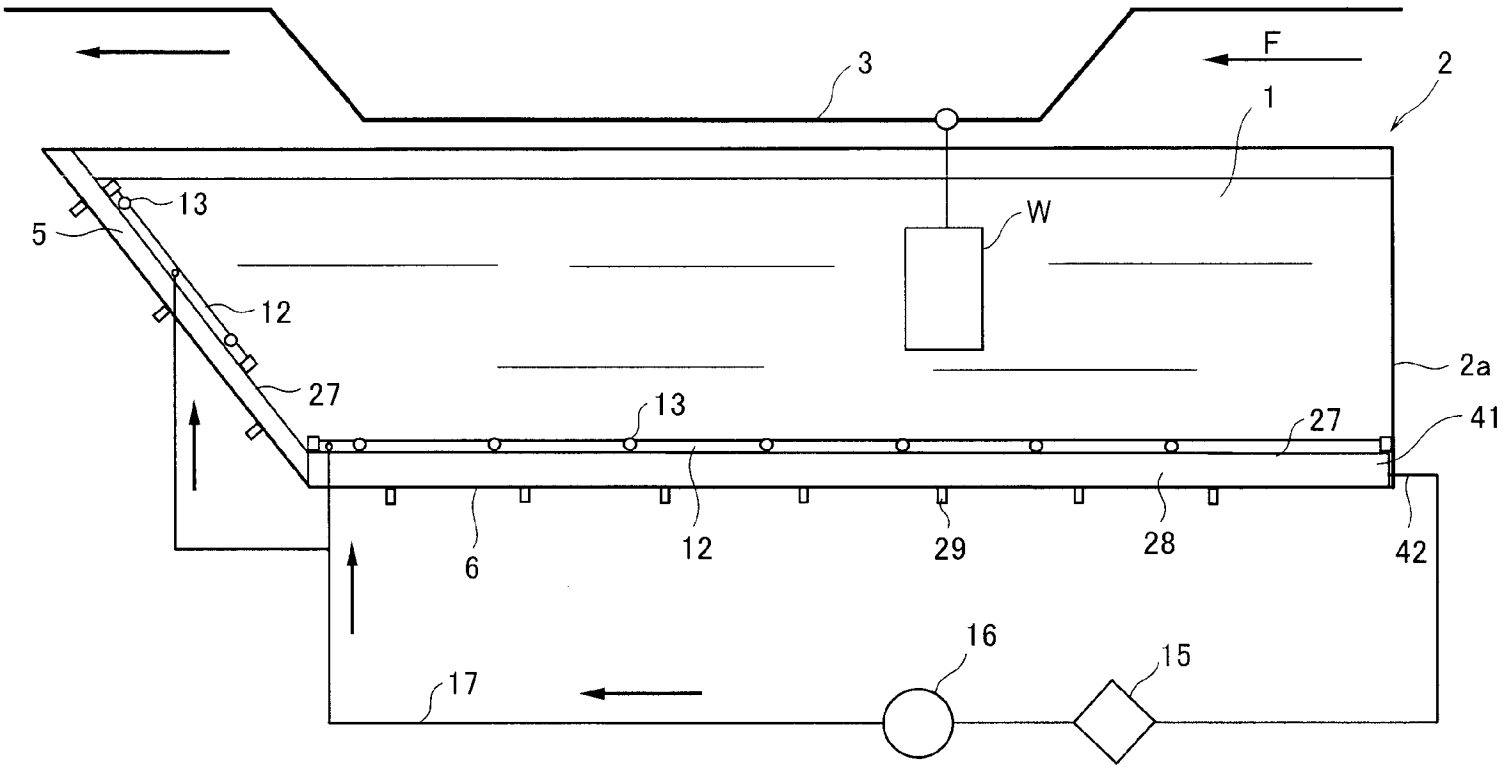
FIG. 8 is an explanatory diagram of a schematic configuration of a second embodiment of a processing tank according to the present invention.
Figure 9:
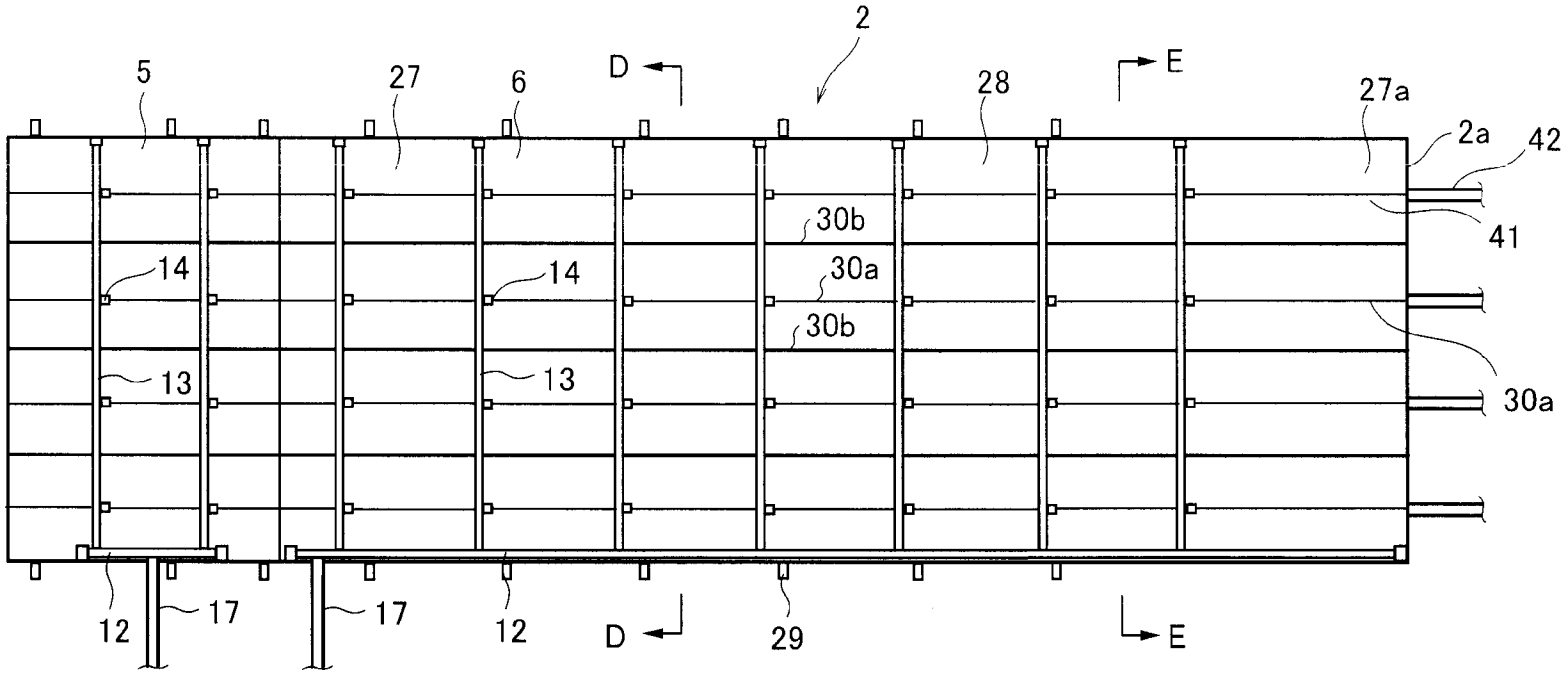
FIG. 9 is a plan view of the second embodiment of a processing tank according to the present invention.
Figure 10:
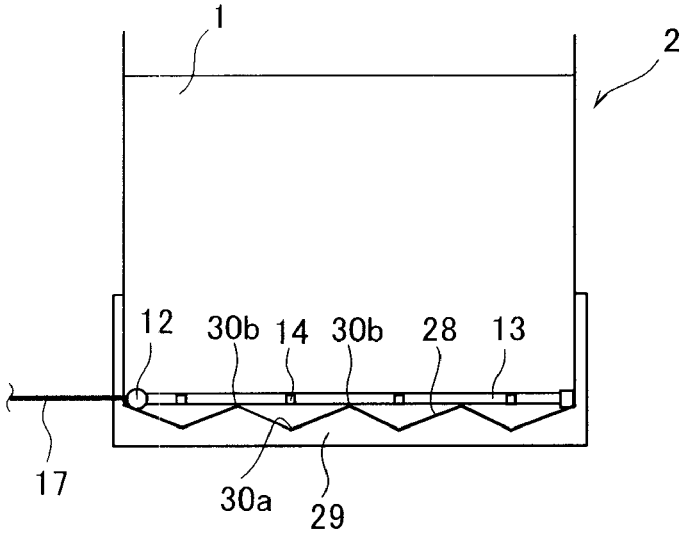
FIG. 10 is a cross-sectional fragmentary view taken along D-D in FIG. 9.
Figure 11:
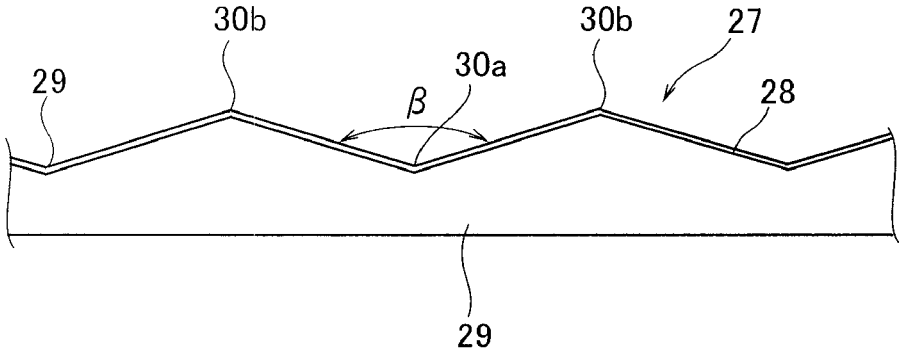
FIG. 11 is an enlarged view of a substantial part of FIG. 10.

Next, as illustrated in FIGS. 8 and 9, a second embodiment of a processing tank according to the present invention differs from the first embodiment in the shape of a grooved part 27 formed on an inclined part 5 and the bottom surface 6 of an electrodeposition tank 2. Otherwise, the configuration is the same as the first embodiment. As illustrated in FIG. 10, a cross section of the grooved part 27 is formed in a serrated shape. The grooved part 27 is formed by welding and bonding together a plurality of steel plate members 28 having a plurality of concave and convex shapes (a shape in which serrated shapes are arranged side by side), and reinforcing an outer frame of the welded and bonded steel plate members 28 with a reinforcing member 29. Concavities 30*a* of the grooved part 27 are valleys of the steel plate members 28, and convexities 30*b* of the grooved part 27 are ridges of the steel plate members 28. In addition, as illustrated in FIG. 11, an angle $\beta$ of the valley 30*a* that constitutes the grooved part 27 is to be set so as to range between 90° and 165°.

Figure 12:
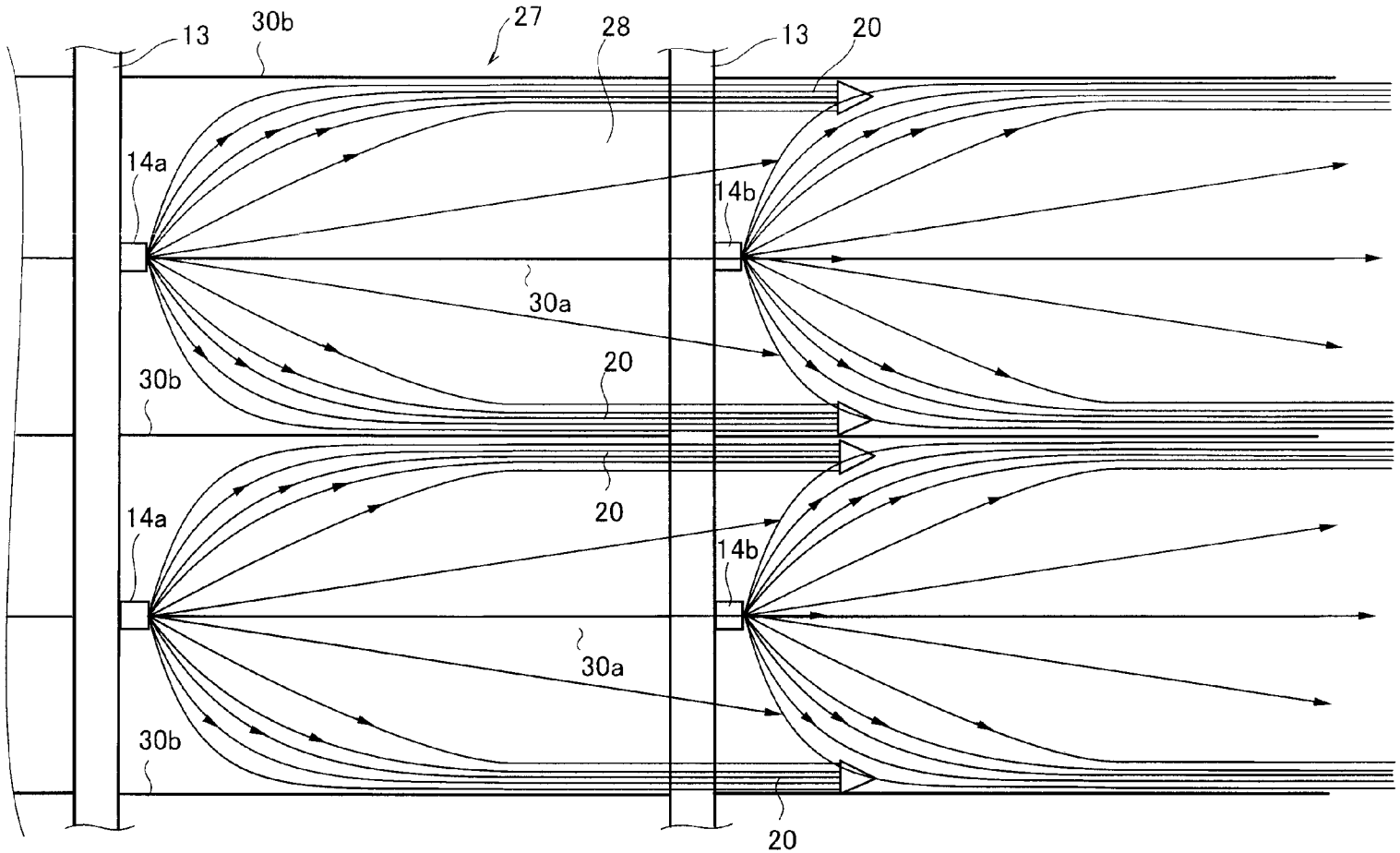
FIG. 12 is an explanatory diagram of operations of the second embodiment.

A description of operations of the second embodiment of a processing tank according to the present invention configured as described above will now be given. As illustrated in FIG. 12, electrodeposition paint 1 ejected from an electrodeposition paint discharge nozzle 14*a* of a branch pipe 13 positioned on the downstream-side in a work-conveying direction initially flows from the center of a valley 30*a* of the grooved part 27 toward ridges 30*b* on both sides of the center of the valley 30*a* and toward a collecting part 41, carries away and agitates pigment components and the like which naturally tend to settle and solidify on the inclined part 5 and the bottom surface 6, and disperses the pigment components and the like, which naturally tend to settle and solidify, into the electrodeposition paint 1. Subsequently, the pigment components and the like, which naturally tend to settle and solidify, converge in a vicinity of the ridges 30*b* on both sides, become a strong flow 20 along the ridges 30*b*, and is further carried toward the collecting part 41.

The pigment components and the like, which naturally tend to settle and solidify, being carried toward the hopper 4 are then carried by flow of the electrodeposition paint 1 ejected from an electrodeposition paint discharge nozzle 14*b* of a branch pipe 13 positioned on the upstream-side of the aforementioned electrodeposition paint discharge nozzle 14 in the work-conveying direction and are further carried and agitated toward the collecting part 41. As a result, the pigment components and the like, which naturally tend to settle and solidify, are dispersed into the electrodeposition paint 1. In this manner, the pigment components and the like, which naturally tend to settle and solidify on the inclined part 5 and the bottom surface 6 of the electrodeposition tank 2, are carried by the flow of the electrodeposition paint 1 ejected from the electrodeposition paint discharge nozzle 14 as described above and converge in the vicinity of the ridges 30*b* to be agitated, and are consecutively carried away toward the collecting part 41. Finally, as the flow of the electrodeposition paint 1 collides with the end surface 2*a* of the electrodeposition tank 2, the pigment components and the like, which naturally tend to settle and solidify, are agitated and dispersed. At this point, electrodeposition paint 1 with a high concentration of the pigment components and the like exists at each bottom part 10*a* constituting the collecting part 41.

Figure 13:
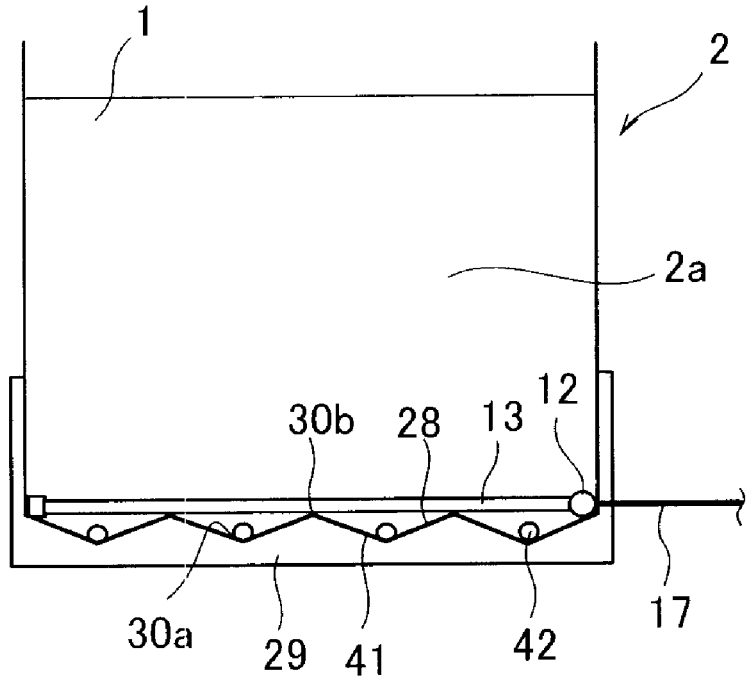
FIG. 13 is a cross-sectional fragmentary view taken along E-E in FIG. 9.

Subsequently, as illustrated in FIG. 13, the electrodeposition paint 1 with a high concentration of the pigment components and the like which exists at the collecting part 41 is suctioned by the circulation pump 16 through the discharge pipe 42 and is once again ejected from the electrodeposition paint discharge nozzle 14 mounted on the branch pipe 13 via a filter 15 arranged on the electrodeposition paint circulation pipe 17 and further via the electrodeposition paint supply pipe 12. In this manner, all pigment components and the like, which naturally tend to settle and solidify, are reliably agitated and ejected from the electrodeposition paint discharge nozzle 14 as the electrodeposition paint 1.

At this point, if the angle β of the valley 30*a* exceeds 165°, an incline from the valley 30*a* to the ridge 30*b* becomes gentler. Consequently, an ejection flow of the electrodeposition paint 1 ejected from the electrodeposition paint discharge nozzle 14 diffuses, making it difficult for pigment components and the like, which naturally tend to settle and solidify, to be carried to a position of an ejection flow of the electrodeposition paint 1 ejected from the electrodeposition paint discharge nozzle 14 of an adjacent branch pipe 13, and causes the pigment components and the like to settle and solidify. In particular, it becomes difficult for ejection flows of the electrodeposition paint 1 ejected from the electrodeposition paint discharge nozzles 14 to converge and carry away the pigment components and the like, which naturally tend to settle and solidify, in the vicinity of the ridges 30*b* on both sides, creating a problem in that pigment components and the like settle and solidify in the vicinity of the ridges 30*b* on both sides.

When a discharge pressure and a discharge rate of the electrodeposition paint discharge nozzle 14 are increased in order to prevent such a problem, the size of the circulation pump 16 must be increased, resulting in greater cost. On the other hand, if the angle β of the valley 30*a* is less than 90°, an incline from the valley 30*a* to the ridge 30*b* becomes steep. Consequently, it becomes difficult for ejection flows of the electrodeposition paint 1 ejected from the electrodeposition paint discharge nozzles 14 to converge in the vicinity of the ridges 30*b* on both sides, creating a problem in that pigment components and the like settle and solidify in the vicinity of the ridges 30*b* on both sides. An angle β of less than 90° also reduces the interval of the ridges 30*b*, thereby increasing the number of the electrodeposition paint discharge nozzles 14 and resulting in greater cost.

In addition, as for the elevation angle α of the electrodeposition paint discharge nozzle 14, an elevation angle α of less than 10° makes it difficult to have the pigment components and the like, which naturally tend to settle and solidify, be carried and agitated towards the collecting part 41. Consequently, a problem arises in that the pigment components and the like settle and solidify. On the other hand, if the elevation angle α of the electrodeposition paint discharge nozzle 14 exceeds 60°, since sedimentable components of the electrodeposition paint 1 can no longer be sufficiently carried away, an installation interval of the branch pipes 13 must be reduced. However, reducing the installation interval increases the numbers of the branch pipes 13 and the electrodeposition paint discharge nozzles 14, resulting in greater cost.

Moreover, a discharge pressure and a discharge rate of the circulation pump 16 are to be appropriately set in consideration of the area sizes of the inclined part 5 and the bottom surface 6 of the electrodeposition tank 2, the shape of the steel plate member 28, the elevation angle α of the electrodeposition paint discharge nozzle 14, the specific gravity of the pigment components and the like with a natural tendency to settle and solidify, and the like. The installation interval of the branch pipes 13 is to be appropriately set in consideration of the area sizes of the inclined part 5 and the bottom surface 6 of the electrodeposition tank 2, the shape of the steel plate member 28, the elevation angle α of the electrodeposition paint discharge nozzle 14, the specific gravity of the pigment components and the like with a natural tendency to settle and solidify, and the like, as well as the discharge pressure and the discharge rate of the circulation pump 16 set according thereto.

Moreover, the provision of the collecting part 41 is not limited to the end part 27*a* of the grooved part 27. For example, the collecting part 41 may be provided at the center in a work-conveying direction or at an appropriate position in the electrodeposition tank 2, and the discharge pipe 42 to be connected to the electrodeposition paint circulation pipe 17 may be mounted on the collecting part 41 so as to communicate with each valley 30*a* of the grooved part 27. In addition, a configuration may be adopted in which the collecting part 41 is formed as a hopper whose upper opening is positioned on the end surface 2*a* of the electrodeposition tank 2 near the bottom surface 6 and the electrodeposition paint circulation pipe 17 is connected to a lower part of the hopper.

As described above, since sedimentable components are constantly moved, circulated, and agitated by a flux flowing along the bottom surface 6 of the electrodeposition tank 2 before the sedimentable components adhere to and solidify on the bottom surface 6, solidification of the sedimentable components on the bottom surface 6 can be avoided. Accordingly, since the electrodeposition paint 1 can be reliably used for an electrodeposition process of an object to be processed and a regular cleaning interval of the electrodeposition tank 2 can be extended, cost reduction can be achieved. In addition, a failure in which solidified pigment components and the like are detached from a wall surface of the electrodeposition tank 2 adhere to a processed object and become faulty can be reliably prevented.

INDUSTRIAL APPLICABILITY

According to the present invention, even a component with a natural tendency to settle and solidify in a processing tank or the like can be moved, circulated, and agitated by a flow of a processing liquid ejected from a processing liquid discharge nozzle. Consequently, solidification of sedimentable components on the bottom surface of the processing tank can be prevented, the processing liquid can be reliably used to process an object to be processed, and a regular cleaning interval of the electrodeposition tank 2 can be extended. As a result, cost reduction can be achieved and a processing tank capable of achieving cost reduction can be provided.

The invention claimed is:

1. A processing tank assembly for pooling and enabling fluidization and agitation of a processing liquid into which a work is to be immersed, the processing tank assembly comprising:

a processing tank having a grooved part, said grooved part having a plurality of concave and convex shapes formed along a work-conveying direction on a bottom surface of the processing tank;

a processing liquid supply pipe configured to circulate and supply the processing liquid to the processing tank, said processing liquid supply pipe being disposed within said processing tank adjacent said grooved part;

a plurality of branch pipes that extend transverse to the work-conveying direction and are abuttingly supported by convexities of the grooved part, each of said branch pipes branching off the processing liquid supply pipe; and processing liquid discharge nozzles, said nozzles being provided on the branch pipes and being directed generally opposite to the work-conveying direction, said nozzles being disposed generally at a center of concavities of the grooved part and intermediate adjacent convexities.

2. The processing tank assembly according to claim 1, wherein the grooved part is formed by arranging, side by side, steel plate members having serrated shapes, the concavities are valleys of the steel plate members, and the convexities are ridges of the steel plate members.

3. The processing tank assembly according to claim 1, wherein said nozzles are oriented at an elevation angle with respect to said bottom surface, and said elevation angle is between 10° and 60°.

4. The processing tank assembly according to claim 3, wherein the angle of the valley of the steel plate members is set so as to range between 90° and 165°.

5. The processing tank assembly according to claim 1, wherein a space within said processing tank above said branch pipes contains processing liquid but is otherwise generally open so as to permit said work to be inserted into said tank, submerged in said processing liquid, and conveyed in the work-conveying direction while submerged in said processing liquid.

* * * * *